US006732989B1

(12) United States Patent
Kao

(10) Patent No.: US 6,732,989 B1
(45) Date of Patent: May 11, 2004

(54) TOOL SUSPENSION DEVICE

(76) Inventor: Jui-Chien Kao, No. 358, Tunghsing Rd., Shuwang Li, Tali City, Taichung Hsien (TW)

( * ) Notice: Subject to any disclaimer, the term of this patent is extended or adjusted under 35 U.S.C. 154(b) by 0 days.

(21) Appl. No.: 10/390,201

(22) Filed: Mar. 17, 2003

(51) Int. Cl.[7] ..... A47F 5/00
(52) U.S. Cl. ..... 248/309.1; 206/349; 211/70.6
(58) Field of Search ..... 248/309.1, 110–113, 248/346.03, 346.04, 318, 362, 363, 693; 206/349, 376, 477, 461; 211/70.6

(56) References Cited

U.S. PATENT DOCUMENTS 4,729,473 A * 3/1988 Kulzer et al. ..... 206/477
4,872,551 A * 10/1989 Theros ..... 206/349
5,435,447 A * 7/1995 Weatherford et al. ..... 206/349
5,988,381 A * 11/1999 Ling ..... 206/349
5,996,817 A * 12/1999 Kao ..... 211/70.6
6,164,463 A * 12/2000 Lee ..... 211/70.6
6,186,323 B1 * 2/2001 Jansson et al. ..... 206/349
6,193,200 B1 * 2/2001 Kao ..... 248/309.1
6,241,208 B1 * 6/2001 Lin ..... 248/309.1
6,375,005 B1 * 4/2002 McCann ..... 206/349
6,378,700 B1 * 4/2002 Tong ..... 206/376

* cited by examiner

*Primary Examiner*—Leslie A. Braun
*Assistant Examiner*—Tan Le
(74) *Attorney, Agent, or Firm*—Thomas, Kayden, Horstemeyer & Risley, LLP

(57) ABSTRACT

A tool suspension device for pliers includes a suspension board, a holding assembly and a feature to clamp and hold one handle of the pliers stationary. The suspension board has a front, a right side, a left side, a top, a bottom, a jaw stop and a hanging hole. The holding assembly has a tool bracket and two mounting brackets. The tool bracket has an elongated tool slot and is mounted on the front of the suspension board in the mounting brackets. The tool slot in the holding assembly holds the pliers on the suspension board. A feature is implemented either in the tool slot or by a separate clamping feature on the suspension board to hold one handle of the pliers stationary. The pliers can be checked and operated on the tool suspension device.

6 Claims, 10 Drawing Sheets

TOOL SUSPENSION DEVICE

BACKGROUND OF THE INVENTION

1. Field of the Invention

The present invention relates to a tool suspension device, and more particularly to a tool suspension device suitable for pliers and also suitable for a person to conveniently manually operate the pliers on the tool suspension device.

2. Description of Related Art

Pliers are used to grip small objects and bend or cut wire. A pair of pliers generally comprises two handles pivotally connected, jaws and a wire cutter. The jaws are used to clamp, and the wire cutter is used to cut wire. Checking the operation and condition of the jaws and the wire cutter is important before a person purchases the pliers.

A conventional tool suspension device is used to display tools such as pliers and comprises a see-through plastic case and a cardboard card. The plastic case has a cavity in a shape corresponding to the tool. The plastic case is attached to the cardboard card, and the tool is mounted in the cavity between the plastic case and the cardboard card. This kind of tool suspension device only allows a person to see the tool. People who want to buy the tool cannot handle the tool or physically check the operation and condition of the features of the tool without removing the see-through case.

To overcome the previously described shortcoming, another conventional tool suspension device was developed for pliers and the like and comprises a suspension board and a mounting bracket. The suspension board has a front, and the mounting bracket is attached to the front of the suspension board. A tool slot is vertically defined through the mounting bracket, and a pair of pliers can be held in the tool slot. Although such a configuration holds and suspends the pliers, the suspension device still cannot be effectively used with some specialty pliers. For example, some conventional pliers with two handles connected at a pivot point have a compression spring mounted between the two handles near the pivot point. A user squeezes the handles of the pliers when performing a task, and the compression spring presses the handles apart when the handles are released. The compression spring in the pliers must normally be compressed to mount the pliers in the tool slot in the suspension device. Constant compression of the compression spring for a long period of time will likely deform the compression spring permanently so it will not be able to perform its original function.

To overcome the shortcomings, the present invention provides a tool suspension device for pliers to mitigate or obviate the aforementioned problems.

SUMMARY OF THE INVENTION

The main objective of the invention is to provide a way for a person to conveniently check the operation and condition of pliers suspended on a tool suspension device.

Another objective of the invention is to provide a way to suspend pliers with a compression spring mounted between the handles on a tool suspension device without adversely affecting the resilience of the compression spring.

Other objectives, advantages and novel features of the invention will become more apparent from the following detailed description when taken in conjunction with the accompanying drawings.

DETAILED DESCRIPTION OF PREFERRED EMBODIMENT

Figure 1:
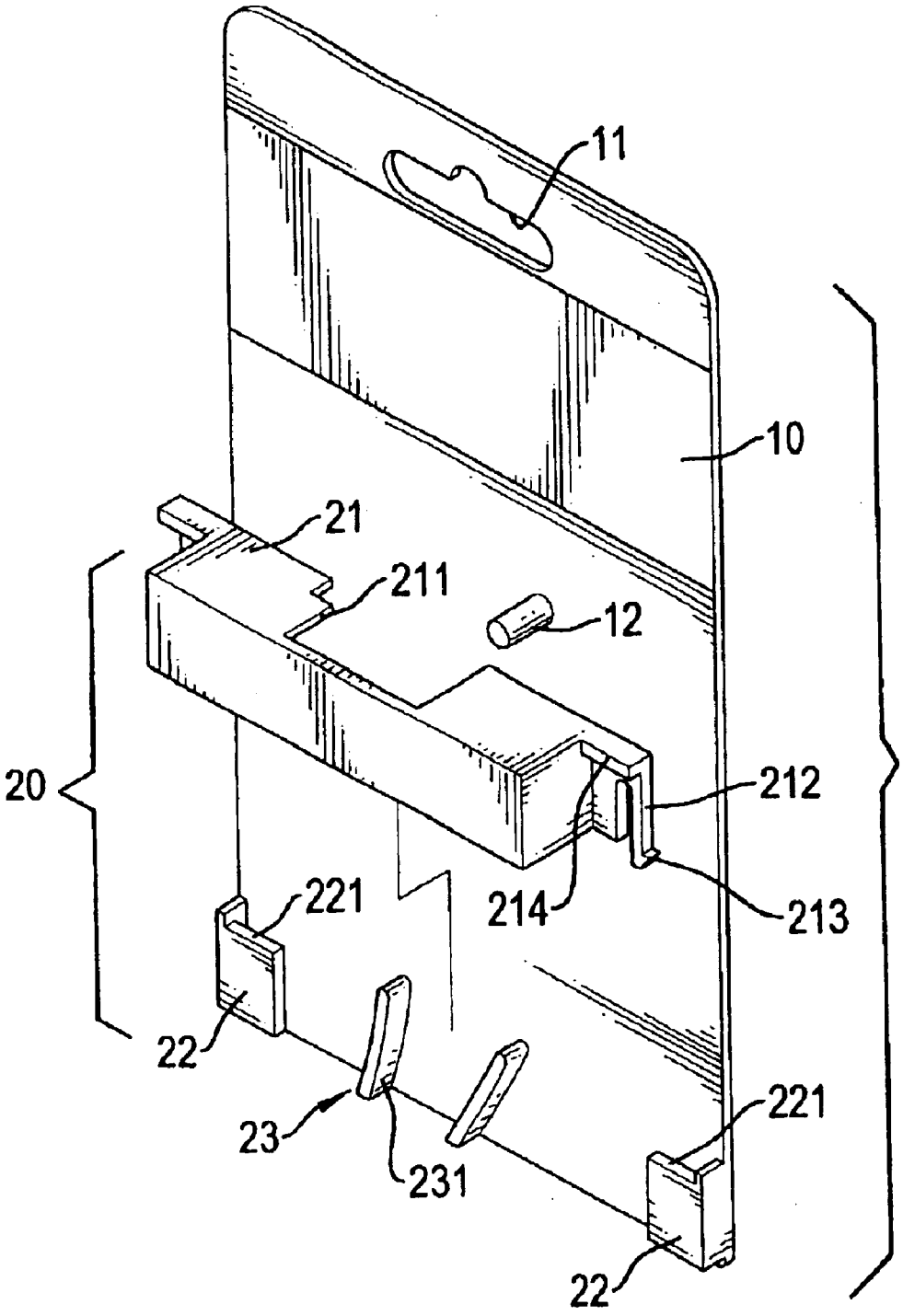
FIG. 1 is an exploded perspective view of a first embodiment of a tool suspension device for pliers in accordance with the present invention.

With reference to FIGS. 1, 2, 6 and 7, a tool suspension device in accordance with the present invention comprises a suspension board (10), a holding assembly (20, 20') and a clamping feature. The holding assembly (20, 20') securely holds a pair of pliers such as a pair of needle-nose pliers (30) or a pair of combination pliers (30') on the suspension board (10). The clamping feature to securely hold one handle (31, 31') with a corresponding jaw (not numbered) of a pair of pliers (30, 30') in a stationary position and allows another handle (32, 32') with a corresponding jaw (not numbered) to be operated.

Figure 2:
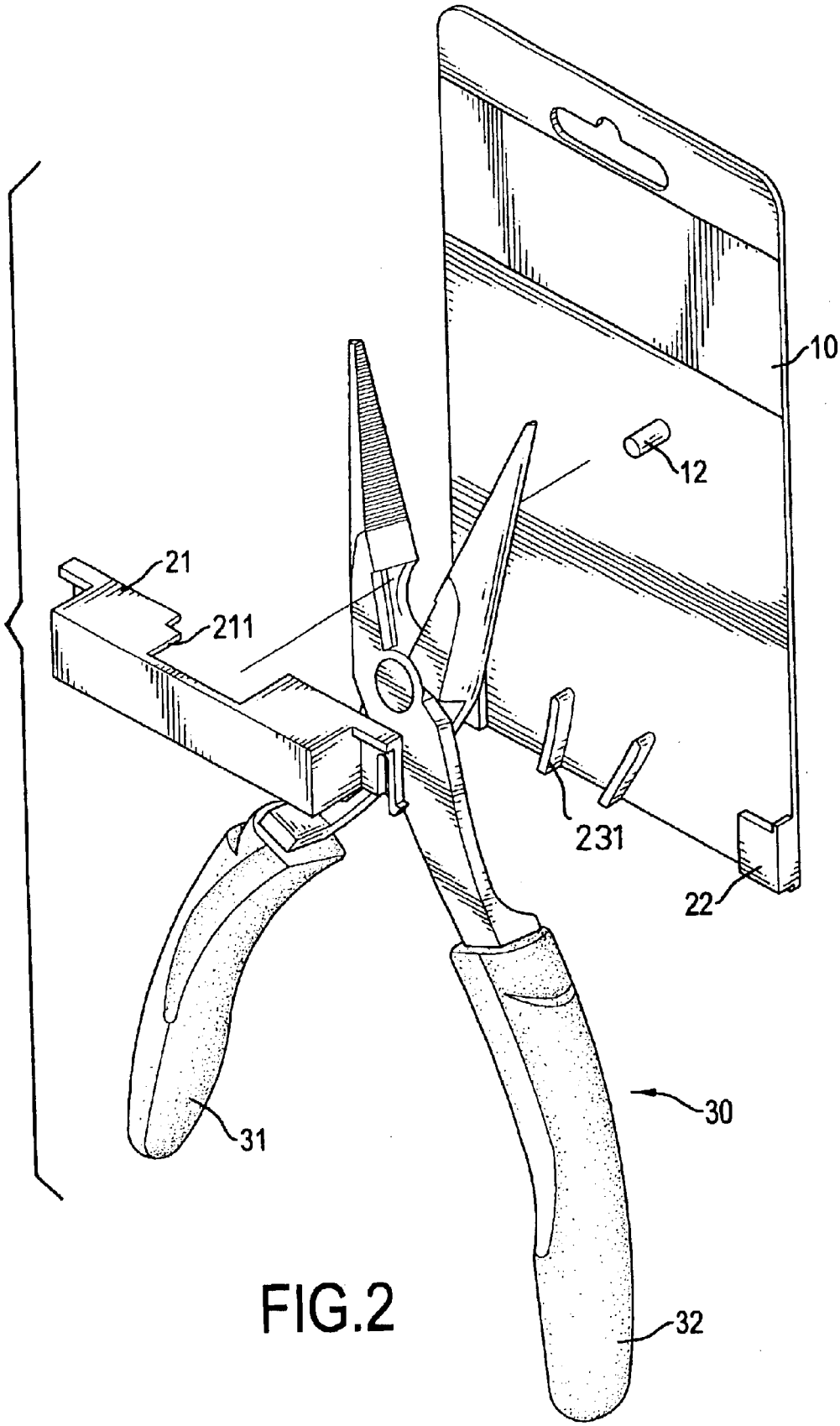
FIG. 2 is an operational, exploded perspective view of the tool suspension device in FIG. 1 with a pair of needle-nose pliers mounted on the device.
Figure 3:
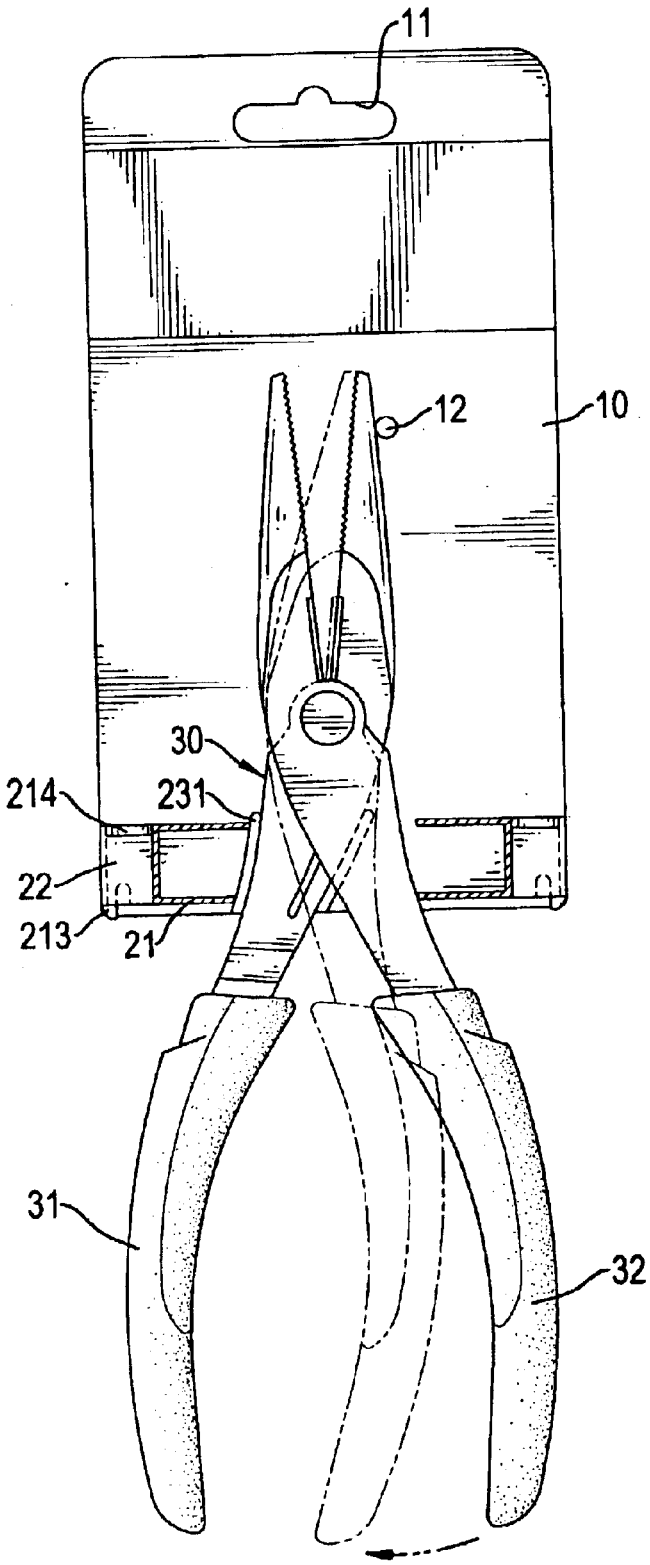
FIG. 3 is an operational front plan view in partial section of the tool suspension device in FIG. 2.

With reference to FIGS. 1 to 3, a first embodiment of the tool suspension device in accordance with the present invention comprises a suspension board (10), a holding assembly (20) and a clamping feature (23). The suspension board (10) has a front (not numbered), a right side (not numbered), a left side (not numbered), a top (not numbered), a bottom (not numbered), a hanging hole (11) and a jaw stop (12). The hanging hole (11) is defined through the front near the top of the suspension board (10) and is adapted to hang on a display stand (not shown). The jaw stop (12) is mounted on and protrudes from the front near the right side of the suspension board (10).

The holding assembly (20) is mounted on the front near the bottom of the suspension board (10) to hold a pair of needle-nose pliers (30) on the front of the suspension board (10). When mounted on the tool suspension device, the needle-nose pliers (30) have a stationary handle (31) with a stationary jaw (not numbered) and a moveable handle (32) with a moveable jaw (not numbered) that are pivotally joined together at a pivot point (not numbered).

The holding assembly (20) comprises a tool bracket (21) and two mounting brackets (22). The tool bracket (21) has a front (not numbered), a top (not numbered), a bottom (not numbered), two opposite sides (not numbered), an elongated tool slot (211), two mounting wings (not numbered), two spacer slots (not numbered), a resilient arm (212), two hooks (213) and two positive stops (214) and is made by injection molding plastic. The elongated tool slot (211) is defined through the tool bracket (21) from the top to the bottom between the two sides and is enclosed by the front of the bracket (21) to hold the two handles (31, 32) of the pliers (30) against the suspension board (10). The mounting wings are formed respectively at opposite sides of the tool bracket (21). The spacer slots are defined respectively in the bottom of opposite mounting wings to form a resilient arm (212) in each mounting wing at each side of the tool bracket (21). Each resilient arm (212) has a distal end (not numbered) that extends below the bottom of the tool bracket (21). The hooks (213) are formed respectively on and extend from the distal ends of the resilient arms (212) at each side of the tool bracket (21). The positive stops (214) are formed at the top of the tool bracket (21) respectively from the mounting wings and protrude toward the front of the tool bracket (21).

The mounting brackets (22) are formed on the bottom front of the suspension board (10) respectively at the right and left side and correspond to the mounting wings of the tool bracket (21). Each mounting bracket (22) is L-shaped, has a top (not numbered), a bottom (not numbered), a short side (not numbered), an elongated front (not numbered), a notch (221) and a gap (not numbered). The short sides of mounting brackets (22) are attached to and extend from the front of the suspension board (10) respectively at the right and left side of the suspension board (10). The elongated fronts are attached respectively to the short sides to form the gaps between the elongated fronts and the front of the suspension board (10), and the gaps face each other. The notches (221) are defined respectively in the top of the mounting brackets (22) and correspond to the respective positive stops (214) on the tool bracket (21). The positive stops (214) on the tool bracket (21) are respectively received in the notches (221) in the mounting brackets (22), and the mounting wings of the tool bracket (21) are respectively held in the gaps between the suspension board (10) and the mounting brackets (22) when the mounting wings are inserted into the gaps. The hooks (213) on the resilient arms (212) respectively engage the bottoms of the mounting brackets (22) such that the tool bracket (21) is securely held on the front of the suspension board (10).

The clamping feature (23) securely holds the stationary handle (31) of the needle-nose pliers (30) and is attached to the front of the suspension board (10) between the mounting brackets (22). The clamping feature (23) is implemented with two handle guides (231) formed on the front of the suspension board (10) in the tool slot (211) of the tool bracket (21) to hold the stationary handle (31) of the needle-nose pliers (30).

Figure 4:
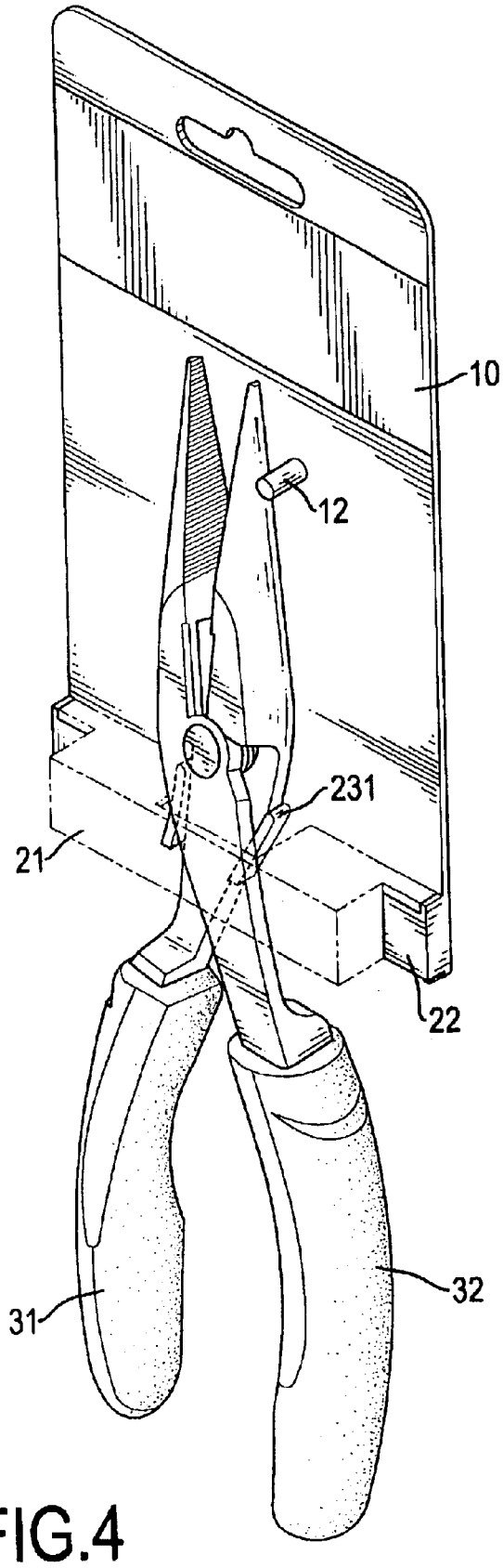
FIG. 4 is an operational perspective view of the tool suspension device in FIG. 2 with the needle-nose pliers mounted on the device.
Figure 5:
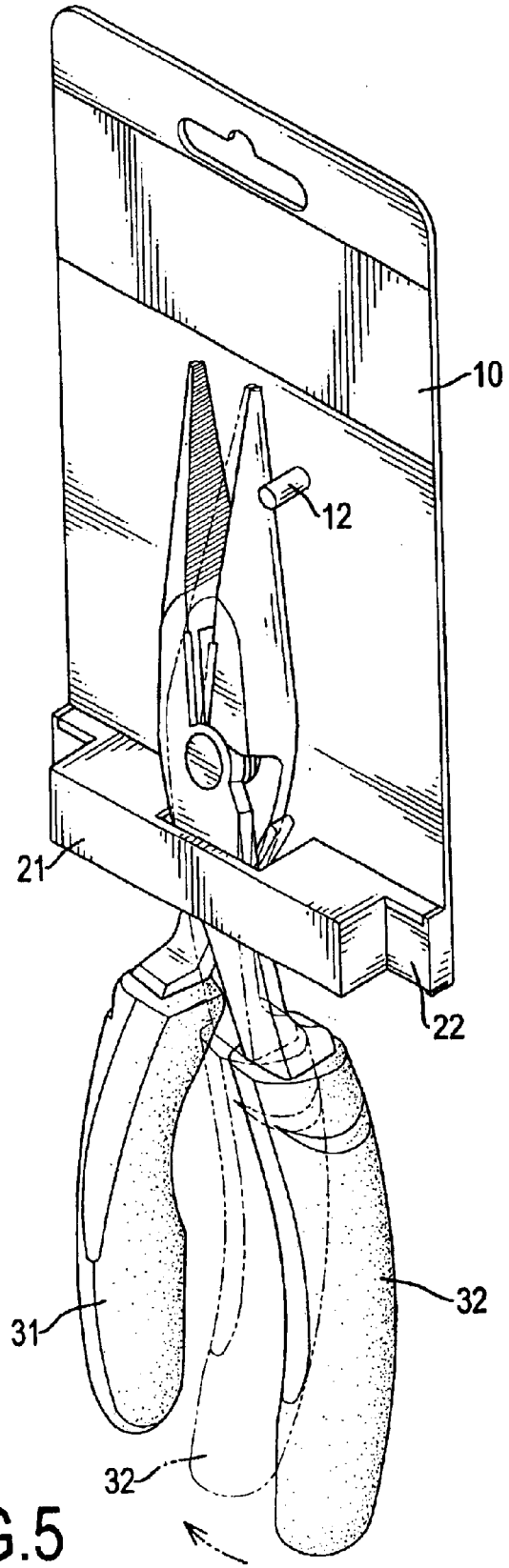
FIG. 5 is an operational perspective view of the tool suspension device in FIG. 2 with needle-nose pliers mounted on the device.

With reference to FIGS. 4 and 5, the tool suspension device is assembled by first mounting the pliers (30) with the two handles (31, 32) on the front of the suspension board (10). The stationary handle (31) of the needle-nose (30) pliers is held between the two handle guides (231), and the stationary jaw of the pliers (30) abuts the jaw stop (12). The tool bracket (21) is mounted on the front of the suspension board (10) in the mounting brackets (22) by positioning the tool slot (211) over the pliers (30) and sliding the mounting wings into the mounting brackets (22). The moveable handle (32) of the pliers (30) will be able to be squeezed in the tool slot (211).

Even needle-nose pliers (30) with a compression spring (not shown) can be mounted easily on the suspension board (10) without compressing the compression spring. The pliers (30) are normally open on the suspension board (10) and can be conveniently checked without removing the pliers (30) from the suspension board (10).

Figure 6:
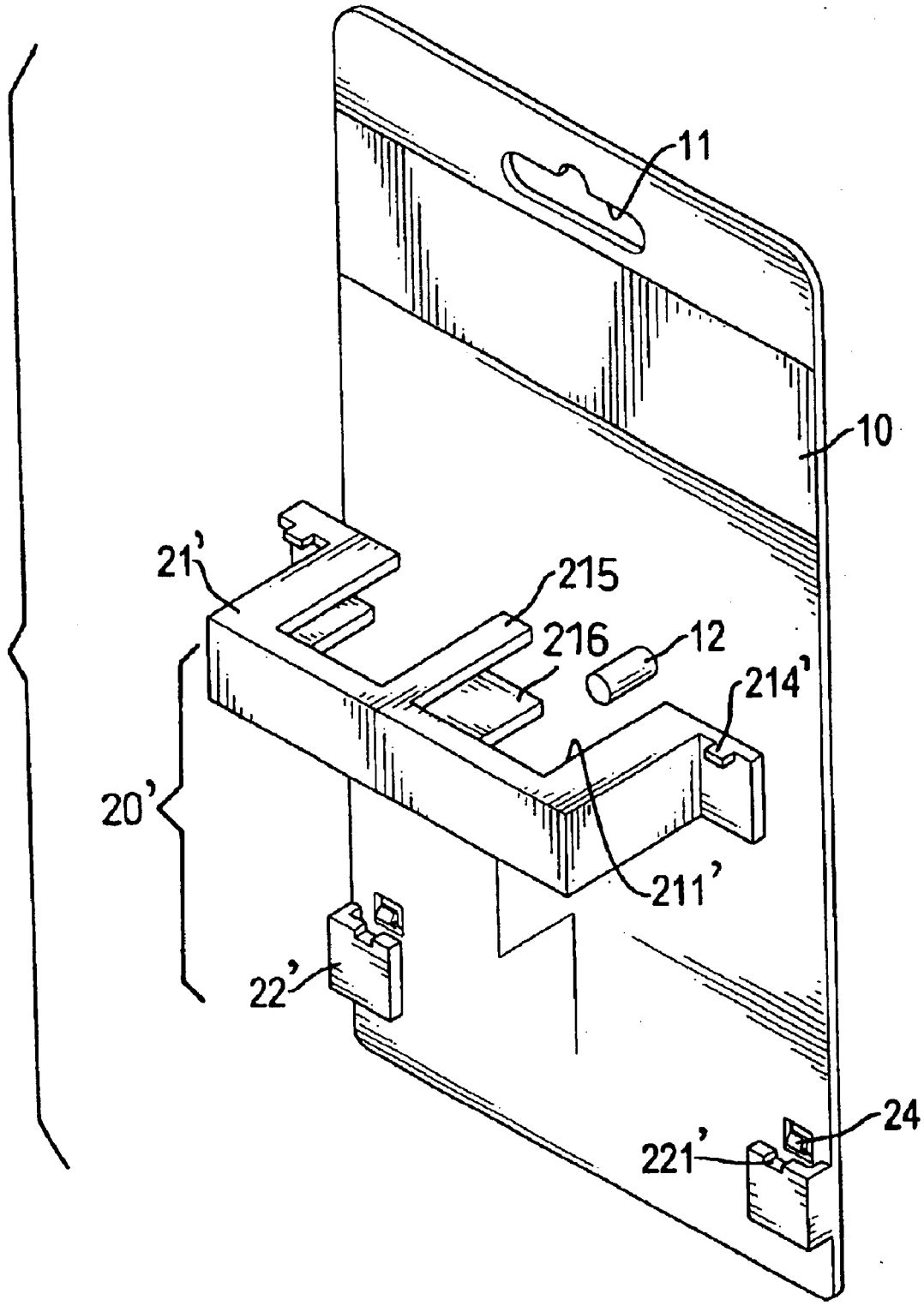
FIG. 6 is an exploded perspective view of a second embodiment of the tool suspension device in accordance with the present invention.
Figure 7:
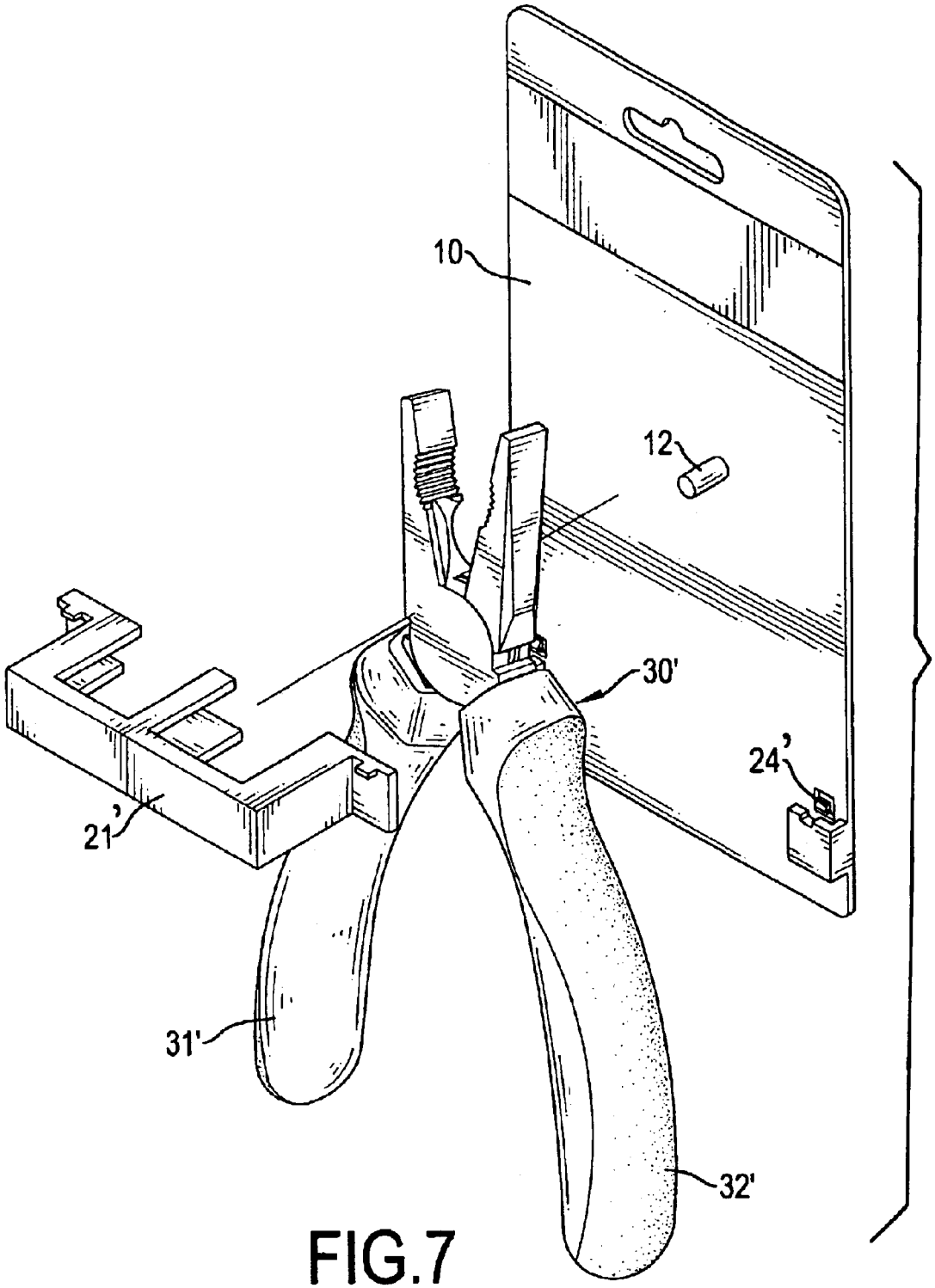
FIG. 7 is an exploded perspective view of the tool suspension device in FIG. 6 with a pair of combination pliers.
Figure 9:
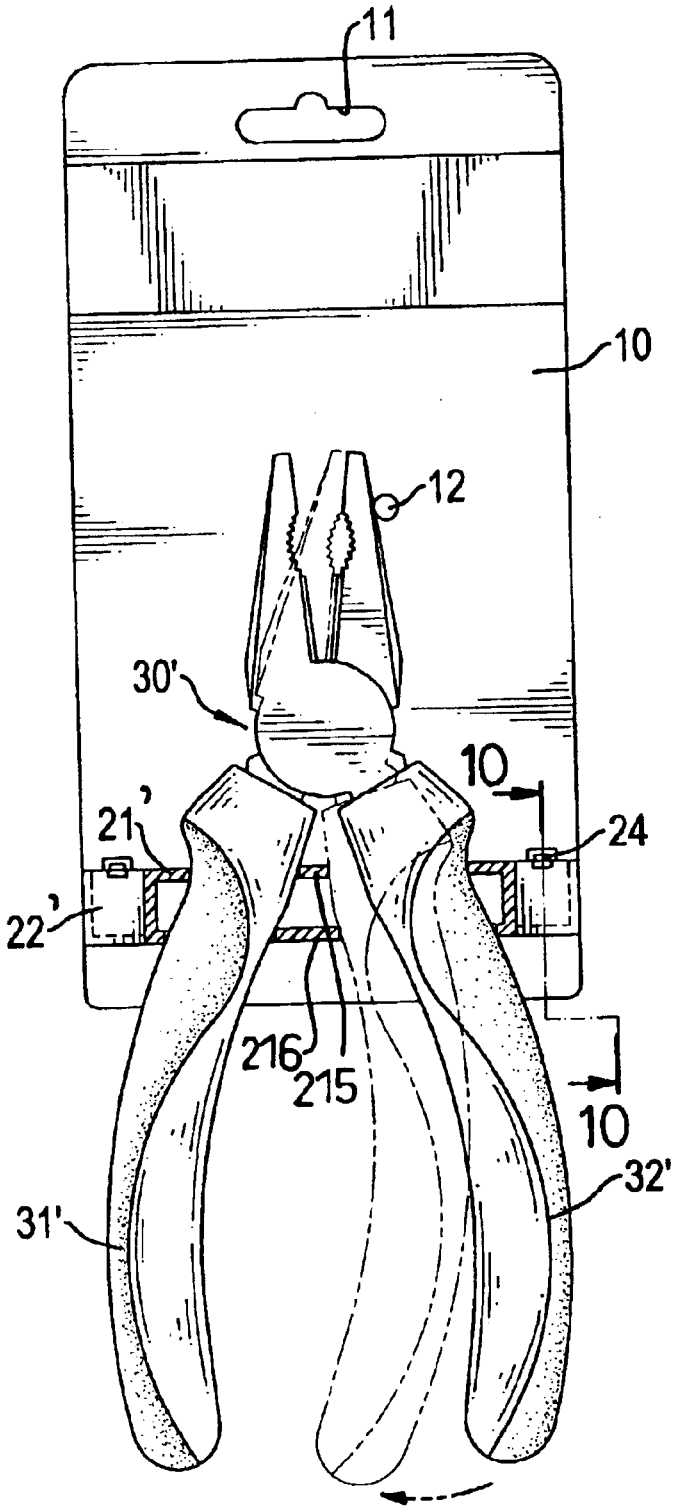
FIG. 9 is an operational front plan view in partial section of the tool suspension device in FIG. 7.

With reference to FIGS. 6, 7 and 9, a second embodiment of the tool suspension device in accordance with the present invention comprises a suspension board (10) and a modified holding assembly (20'). The modified holding assembly (20') incorporates a feature to securely hold a stationary handle (31') of a pair of combination pliers (30') rather than having a separate device to hold the stationary handle (31'). The suspension board (10) is the same as the first embodiment and is not further described.

The holding assembly (20') is mounted on the front near the bottom of the suspension board (10) to hold a pair of combination pliers (30') on the front of the suspension board (10). When mounted on the tool suspension device, the combination pliers (30') have a stationary handle (31') with a stationary jaw (not numbered) and a moveable handle (32') with a moveable jaw (not numbered) that are pivotally joined together at a pivot point (not numbered).

The holding assembly (20') comprises a tool bracket (21'), two mounting brackets (22') and two vertical stops (24). The tool bracket (21') has a front (not numbered), a top (not numbered), a bottom (not numbered), two opposite sides (not numbered), a tool slot (211'), two mounting wings (not numbered) and two positive stops (214') and is made by injection molding plastic. The tool slot (211') is defined through the tool bracket (21') from the top to the bottom between the two sides and is enclosed by the front of the bracket (21') to hold the two handles (31', 32') of the pliers (30') against the suspension board (10). A top divider (215) and a bottom divider (216) protrude into the tool slot (211') from the front of the tool bracket (21') to divide the tool slot (211') into a narrow section (not numbered) and a wide section (not numbered). The mounting wings are formed respectively at opposite sides of the tool bracket (21'). Each mounting wing has a top level with the top of the tool bracket (21'). The positive stops (214') are respectively formed at and protrude from the top of the mounting wings.

The mounting brackets (22') are formed on the bottom front of the suspension board (10) respectively at the right and left side and correspond to the mounting wings of the tool bracket (21'). Each mounting bracket (22') is L-shaped, has a top (not numbered), a bottom (not numbered), a short side (not numbered), an elongated front (not numbered), a notch (221') and a gap (not numbered). The short sides of mounting brackets (22') are attached to and extend from the front of the suspension board (10) respectively at the right and left side of the suspension board (10). The elongated fronts are attached respectively to the short sides to form the gaps between the elongated fronts and the front of the suspension board (10) and the gaps face each other. The notches (221') are defined respectively in the top of the mounting brackets (22') and correspond to the respective positive stops (214') on the tool bracket (21'). The positive stops (214') on the tool bracket (21') are respectively received in the notches (221') in the mounting brackets (22') are respectively held between the suspension board (10) and the mounting brackets (22') when the mounting wings are inserted into the gaps.

Figure 10:
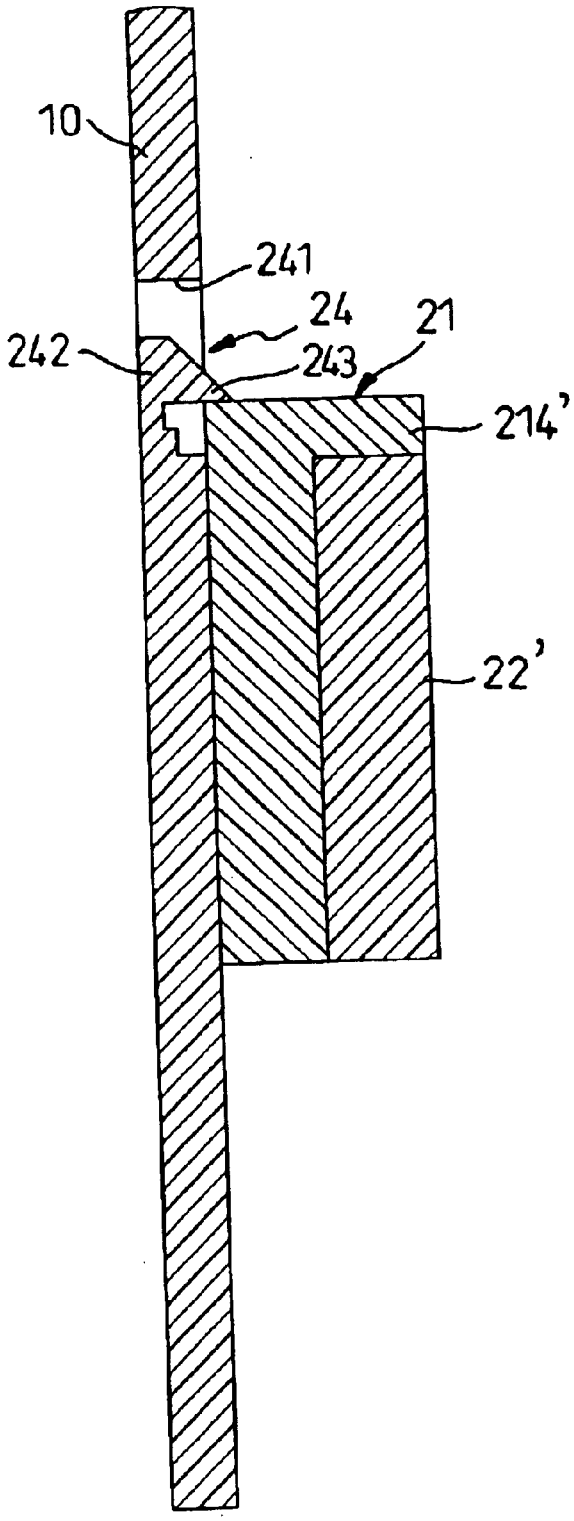
FIG. 10 is an enlarged cross sectional side plan view of a vertical stop along line 10—10 in FIG. 9.

With further reference to FIG. 10, the two vertical stops (24) are formed respectively near the left and right side of the suspension board (10), protrude from the front of the suspension board (10) and correspond to the top of the mounting bracket (22') to securely hold the tool bracket (21') in the mounting brackets (22'). Each vertical stop (24) has a through hole (241), a resilient tab (242) and a hooking protrusion (243). Each through hole (241) extends through the suspension board (10) and has a bottom edge, a top and two sides. The resilient tab (242) is formed in the through hole (241), has a front surface, is attached to the bottom edge and extends toward the top of the through hole (241). The hooking protrusion (243) is formed on front surface of the resilient tab (242), has an inclined top edge (not numbered) and a flat bottom edge, and protrudes from the front of the suspension board (10). The flat bottom edge of the hooking protrusion (243) corresponds to and hooks over the top of the mounting wings on the tool bracket (21') when the tool bracket (21') is mounted in the mounting brackets (22'). The vertical stops (24) keep the tool bracket (21') from moving vertically while the tool bracket (21') is mounted on the front of the suspension board (10) to securely hold a pair of combination pliers (30').

Figure 8:
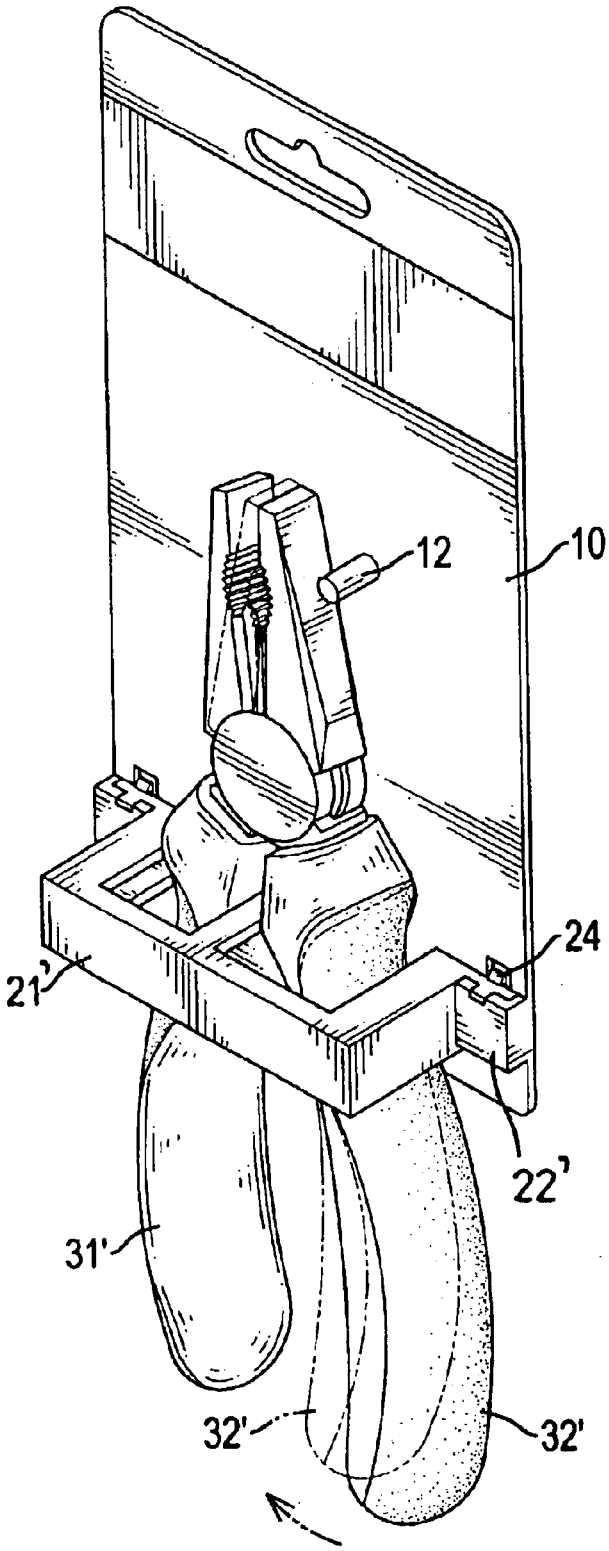
FIG. 8 is an operational perspective view of the tool suspension device in FIG. 7 with combination pliers mounted on the device.

With further reference to FIGS. 8 and 9, the combination pliers (30') are mounted on the tool suspension device by first inserting the stationary handle (31') in the narrow section of the tool slot (211') and the moveable handle (32') in the wide section of the tool slot (211'). The tool bracket (21') with the combination pliers (30') is slid into the mounting slots (22') until the hooking protrusions (243) clip over the top of the wings on the tool bracket (21'). When mounted on the suspension board (10), the combination pliers (31') are open and can be conveniently tested by squeezing the moveable handle (32') toward the stationary handle (31') without removing the pliers (30') from the suspension board (10). Consequently, the tool suspension device does not compress the compression spring in some types of pliers.

The unique features of the first and the second embodiments of the tool suspension device can be interchanged to achieve additional embodiments of the tool suspension device in accordance with the present invention clamping feature (23). For example, the clamping feature (23) in the first embodiment can be replaced and functionally implemented with the tool slot (211') with the top and bottom dividers (215, 216) in the tool bracket (21') in the second embodiment of the tool suspension device to form a third embodiment. A fourth embodiment of the tool suspension device in accordance with the present invention can be implemented by replacing the mounting wings and the mounting bracket (22) in the first embodiment with the mounting wings, the mounting brackets (22') and the vertical stops (24) in the second embodiment Since the clamping feature (23) and the modified tool bracket (21') hold the stationary handles (31, 31') tightly, the pliers (30, 30') cannot be pulled out of the tool slot (211, 211') easily. A person who wants to steal a tool suspended on the tool suspension device cannot remove and easily conceal the tool. Instead the person must take the entire tool suspension device so the tool is more difficult to steal.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A tool suspension device for a tool having a stationary handle with a stationary jaw and a moveable handle with a moveable jaw, which are pivotally joined with each other at a pivot point, and the tool suspension device comprising:

a suspension board with a front, a right side, a left side, a top and a bottom;

a holding assembly mounted on the front of the suspension board and comprising a tool bracket with a front, a top, a bottom and two opposite sides mounted on the front of the suspension board and the tool bracket having an elongated tool slot defined through the top to the bottom of the tool bracket and adapted to hold the handles of the tool;

a mounting wing formed respectively at each opposite side of the tool bracket;

a positive stop protruded at the top of the tool bracket from each mounting wing of the tool bracket;

a spacer slot defined from the bottom of the tool bracket to form a resilient arm at each mounting wing of the tool bracket and each resilient arm having a distal end; and a hook formed on and extended from the distal end of each resilient arm of the tool bracket; and two L-shaped mounting brackets respectively mounted on front of the suspension board corresponding to the mounting wings of the tool bracket and each mounting bracket having a top, a bottom, a short side attached to and extending from the front of the suspension board, an elongated front attached to the short side, a gap formed between each elongated front and the front of the suspension board, and a notch defined in the top of the mounting bracket and corresponding to a respective one of the positive stops on the tool bracket; and two handle guides formed on the front of the suspension board in the tool slot of the tool bracket and adapted to securely hold the stationary handle mounted in the tool wherein each positive stop of the tool bracket is respectively received in the notch in one of the mounting brackets, the mounting wings of the tool bracket are respectively held in the gaps between the suspension board and the mounting brackets, the hook on each resilient arm enrages the bottom of the corresponding one of the mounting brackets, and the tool slot is adapted to allow the movable handle being movably held in the tool slot between the suspension board and the holding assembly.

2. The tool suspension device as claimed in claim 1, wherein a hanging hole is defined through the front near the top of the suspension board and is adapted to hang on a display stand.

3. The tool suspension device as claimed in claim 2, wherein a jaw stop is mounted on the front of the suspension board and is adapted to abut the jaw in the stationary handle of the tool.

4. A tool suspension device for a tool having a stationary handle with a stationary jaw and a moveable handle with a moveable jaw, which are pivotally joined with each other at a pivot point, and the tool suspension device comprising:

a suspension board with a front, a right side, a left side, a top and a bottom;

a holding assembly mounted on the front of the suspension board, and comprising a tool bracket with a front, a top, a bottom and two opposite sides mounted on the front of the suspension board and the tool bracket having an elongated tool slot defined through the top to the bottom of the tool bracket and adapted to hold the handles of the tool:

a mounting wing having a top formed at each side of the tool bracket; and a positive stop protruding from the top of each mounting wing of the tool bracket;

two L-shaped mounting brackets respectively mounted on the front of the suspension board corresponding to the mounting wings of the tool bracket and each mounting bracket having a top, a bottom, a short side attached to and extending from the front of the suspension board, an elongated front attached to the short side, a gap formed between the elongated front and the front of the suspension board, and a notch defined in the top of the mounting bracket and corresponding to a respective one of the positive stops on the tool bracket;

a vertical stop formed on the front of the suspension board corresponding to each mounting bracket and having a through hole defined through the suspension board and having a bottom edge, a top and two sides;

a resilient tab formed in the through hole with the resilient tab attached to the bottom edge and extending toward the top of the through hole and having a front surface; and a hooking protrusion formed on the front surface of the resilient tab and protruding from the front of the suspension board and having an inclined top edge and a flat bottom edge to hook over the top of corresponding one of the mounting wings on tool bracket;

a top divider protruding into the tool slot from the front of the tool bracket; and a bottom divider protruding into the tool slot from the front of the tool bracket in conjunction with the top divider to divide the tool slot into a narrow section and a wide section, wherein the narrow section is adapted to tightly hold the stationary handle, the wide section is adapted to allow the movable handle being movably held in the tool slot, each positive stop of the tool bracket is respectively received in the notch in one of the mounting brackets, the mounting wings of the tool bracket are respectively held in the gaps between the suspension board and the mounting brackets and are respectively clamped by the vertical stops.

5. The tool suspension device as claimed in claim 4, wherein a hanging hole is defined through the front near the top of the suspension board and is adapted to hang on a display stand.

6. The tool suspension device as claimed in claim 5, wherein a jaw stop is mounted on the front of the suspension board and is adapted to abut the jaw in the stationary handle of the tool.

* * * * *